US008660448B2

(12) United States Patent
Otsuka et al.

(10) Patent No.: US 8,660,448 B2
(45) Date of Patent: Feb. 25, 2014

(54) IMAGE FORMING APPARATUS AND IMAGE FORMING METHOD

(75) Inventors: Masayuki Otsuka, Osaka (JP); Takashi Kitagawa, Osaka (JP); Motoyuki Itoyama, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 172 days.

(21) Appl. No.: 13/363,708

(22) Filed: Feb. 1, 2012

(65) Prior Publication Data

US 2012/0201556 A1 Aug. 9, 2012

(30) Foreign Application Priority Data

Feb. 3, 2011 (JP) ..... 2011-022024

(51) Int. Cl.
*G03G 15/06* (2006.01)

(52) U.S. Cl.
USPC ..... 399/55; 399/240; 399/235

(58) Field of Classification Search
USPC ..... 399/55, 240, 235
See application file for complete search history.

(56) References Cited

U.S. PATENT DOCUMENTS

| | | | | |
|---|---|---|---|---|
| 5,532,794 | A | 7/1996 | Tokuyama et al. | |
| 7,668,474 | B2 * | 2/2010 | Muranaka | 399/72 |
| 7,751,736 | B2 | 7/2010 | Watanabe | |
| 2002/0028084 | A1 | 3/2002 | Maebashi et al. | |
| 2006/0239701 | A1 * | 10/2006 | Ishibashi | 399/30 |
| 2009/0202263 | A1 | 8/2009 | Yoshida et al. | |

FOREIGN PATENT DOCUMENTS

| | | | |
|---|---|---|---|
| JP | 5-313454 | A | 11/1993 |
| JP | 10-171185 | A | 6/1998 |
| JP | 2002-72584 | A | 3/2002 |
| JP | 2008-292614 | | 12/2008 |
| JP | 2009-216930 | | 9/2009 |
| JP | 2010-107733 | | 5/2010 |

* cited by examiner

*Primary Examiner* — Walter L Lindsay, Jr.
*Assistant Examiner* — Roy Y Yi
(74) *Attorney, Agent, or Firm* — Nixon & Vanderhye, P.C.

(57) ABSTRACT

An image forming apparatus includes a photoreceptor, a developing apparatus, a developing bias supply power source, a control section for controlling a developing bias, a density sensor, and an arithmetic section. When an image density adjustment operation is performed, the arithmetic section determines a print-time developing bias in accordance with a detection result obtained by detecting, by the density sensor, a plurality of image density adjustment toner images formed by changing a developing bias. The print-time developing bias is set by the control section when printing is performed. also, In a case where a previous print-time developing bias falls within at least a low range of a predetermined range of the developing bias, the arithmetic section determines the print-time developing bias to a value between a reference developing bias for a target image density and the previous print-time developing bias.

9 Claims, 10 Drawing Sheets

FIG. 6

(COEFFICIENT k)

| | | DVB1 (V) | | | | |
|---|---|---|---|---|---|---|
| | | LESS THAN 200 | 200 OR GREATER, BUT LESS THAN 300 | 300 OR GREATER, BUT LESS THAN 400 | 400 OR GREATER, BUT LESS THAN 500 | 500 OR GREATER, BUT LESS THAN 600 |
| \| DVB0-DVB1 \| (V) | 20 OR LESS | 0.50 | 0.65 | 0.80 | 1.00 | 1.00 |
| | GREATER THAN 20, BUT NOT GREATER THAN 30 | 0.50 | 0.65 | 0.80 | 1.00 | 1.00 |
| | GREATER THAN 30, BUT NOT GREATER THAN 40 | 0.50 | 0.65 | 0.80 | 1.00 | 1.00 |
| | GREATER THAN 40, BUT NOT GREATER THAN 50 | 0.50 | 0.65 | 0.80 | 1.00 | 1.00 |
| | GREATER THAN 50, BUT NOT GREATER THAN 60 | 0.60 | 0.70 | 0.80 | 1.00 | 1.00 |
| | GREATER THAN 60 | 0.70 | 0.80 | 0.90 | 1.00 | 1.00 |

IMAGE FORMING APPARATUS AND IMAGE FORMING METHOD

This Nonprovisional application claims priority under 35 U.S.C. §119(a) on Patent Application No. 2011-022024 filed in Japan on Feb. 3, 2011, the entire contents of which are hereby incorporated by reference.

TECHNICAL FIELD

The present invention relates to (i) an image forming apparatus, such as an electrographic electrostatic printing machine, an electrographic laser printer, an electrographic facsimile, etc. and (ii) an image forming method, each of which (i) and (ii) develops, by use of a toner, an electrostatic latent image formed on a photoreceptor and thereby obtains a toner image.

BACKGROUND ART

Image forming apparatuses such as an electrographic printing machine, an electrographic printer, an electrographic facsimile, etc. have been conventionally known. In an electrographic image forming apparatus, a toner image is formed on a surface of a photoreceptor by forming an electrostatic latent image on the surface of the photoreceptor and developing it by use of a toner supplied from a developing apparatus to the surface of the photoreceptor. Then, the toner image is transferred to a sheet such as a paper, etc., and fixed on it by a fixing apparatus.

The electrographic image forming apparatus has a problem that an image density is changed depending on a change in an environment condition around the electrographic image forming apparatus, weariness of the photoreceptor and/or a developer, etc.

In view, the image forming apparatus is arranged such that process control for adjusting the image density is performed for every predetermined numbers of sheets of printing or in accordance with an environment condition such as a temperature, a humidity, etc.

According to the process control, first, a plurality of small toner images (hereinafter referred to as toner patches) having sequentially varied densities are formed on a surface of a photoreceptor (see Patent Literature 1, for example). Then, the densities of the toner patches are detected by a density sensor. After this, control for adjusting an image density is carried out based on a result of the detection. Specifically, a developing bias (hereinafter referred to as a reference developing bias), which serves as a reference for a targeted image density (hereinafter referred to as a target image density), is determined based on the densities of the respective toner patches thus detected by the density sensor.

The density sensor detects the densities of the toner patches that are formed on the surface of the photoreceptor, or, in an arrangement including an intermediate transfer belt, the density sensor detects densities of toner patches that are transferred onto a transfer belt from a surface of a photoreceptor.

CITATION LIST

Patent Literature

Patent Literature 1

Japanese Patent Application Publication, Tokukai, No. 2008-292614 A (Publication Date: Dec. 4, 2008)

SUMMARY OF INVENTION

Technical Problem

However, the arrangement of the patent literature 1 has directly uses, from next printing, the reference developing bias determined by the process control. Because of this, if the process control is performed while a single print job is being executed, an image density is significantly changed, in some case, between an image printed on a page before and the process control and an image printed on a next page after the process control. Particularly, in a case where (i) the image density is significantly increased with respect to a target image density prior to the process control and (ii) the image density is returned to the target image density by the process control, the image density change is noticeable between before and after the process control so that the images on the successive pages cause great visual discomfort in a reader.

The present invention is made in view of the problem, and an object of the present invention is to provide an image forming apparatus and an image forming method, each of which is capable of approximating an image density to a target image density by process control and preventing a significant image density change from being caused between before and after the process control.

Solution to Problem

In order to attain the object, an image forming apparatus of the present invention includes: a photoreceptor; a developing device that forms a toner image by visualizing an electrostatic image formed on the photoreceptor; a developing bias supply power source; a control section that controls a developing bias supplied from the developing bias supply power source to the developing apparatus; a density sensor that detects a density of the toner image; and an arithmetic section that, for an image density adjustment operation, determines a print-time developing bias that the controlling section sets for printing, the arithmetic section determining the print-time developing bias in accordance with a detection result obtained by the density sensor by detecting a plurality of image density detection toner images that are formed by changing a developing bias, wherein: in a case where a previous print-time developing bias, which is a print-time developing bias having been set by a previous image density adjustment operation, falls within at least a low range of a predetermined range of the developing bias, the arithmetic section determines the print-time developing bias to a value between a reference developing bias for a target image density and the previous print-time developing bias.

In order to attain the object, an image forming method of the present invention includes: an arithmetic step for determining, for an image density adjustment operation, a print-time developing bias that the controlling section sets for printing, the arithmetic step including determining the print-time developing bias in accordance with a detection result obtained by detecting densities of a plurality of image density adjustment toner images that are formed by changing a developing bias, wherein: in a case where a previous print-time developing bias, which is a print-time developing bias having been set by a previous image density adjustment operation, falls within at least a low range of a predetermined range of the developing bias, the arithmetic step determines the print-time developing bias to a value between a reference developing bias for a target image density and the previous print-time developing bias.

With the arrangement, in a case where the previous print-time developing bias falls within at least the low range of the predetermined range of the developing bias, the arithmetic section (the arithmetic step) determines the print-time developing bias to the value between the reference developing bias for the target image density and the previous print-time developing bias. Therefore, the developing bias determined as the print-time developing bias by the arithmetic section (the arithmetic step) is used.

With this, it is possible to decrease an image density change between an image printed on a page before an image density adjustment operation and an image printed on a next page after the image density adjustment operation, as compared with a case that the reference developing bias for the target image density is directly used as the print-time developing bias. As such, it is possible to concurrently bring about an effect of approximating an image density to the target image density and an effect of preventing occurrence of a situation that the image density is significantly changed between before and after the image density adjustment operation so that the images on the pages give discomfort in a reader.

Advantageous Effects of Invention

With an arrangement, it is possible to decrease an image density change between an image printed on a page before an image density adjustment operation and an image printed on a next page after the image density adjustment operation, as compared with a case that a reference developing bias for a target image density is directly used as an input time developing bias. As such, it is possible to concurrently bring about an effect of approximating an image density to the target image density and an effect of preventing occurrence of a situation that the image density is significantly changed between before and after the image density adjustment operation so that the images on the pages cause discomfort in a reader.

BRIEF DESCRIPTION OF DRAWINGS

FIG. 6 is a table showing conditions, with reference to which table an arithmetic section shown in FIG. 3 determines a value for a coefficient k used in calculation of a print-time developing bias.

DESCRIPTION OF EMBODIMENTS

Embodiment 1

One embodiment of the present invention is described below with reference to figures.

Figure 1:
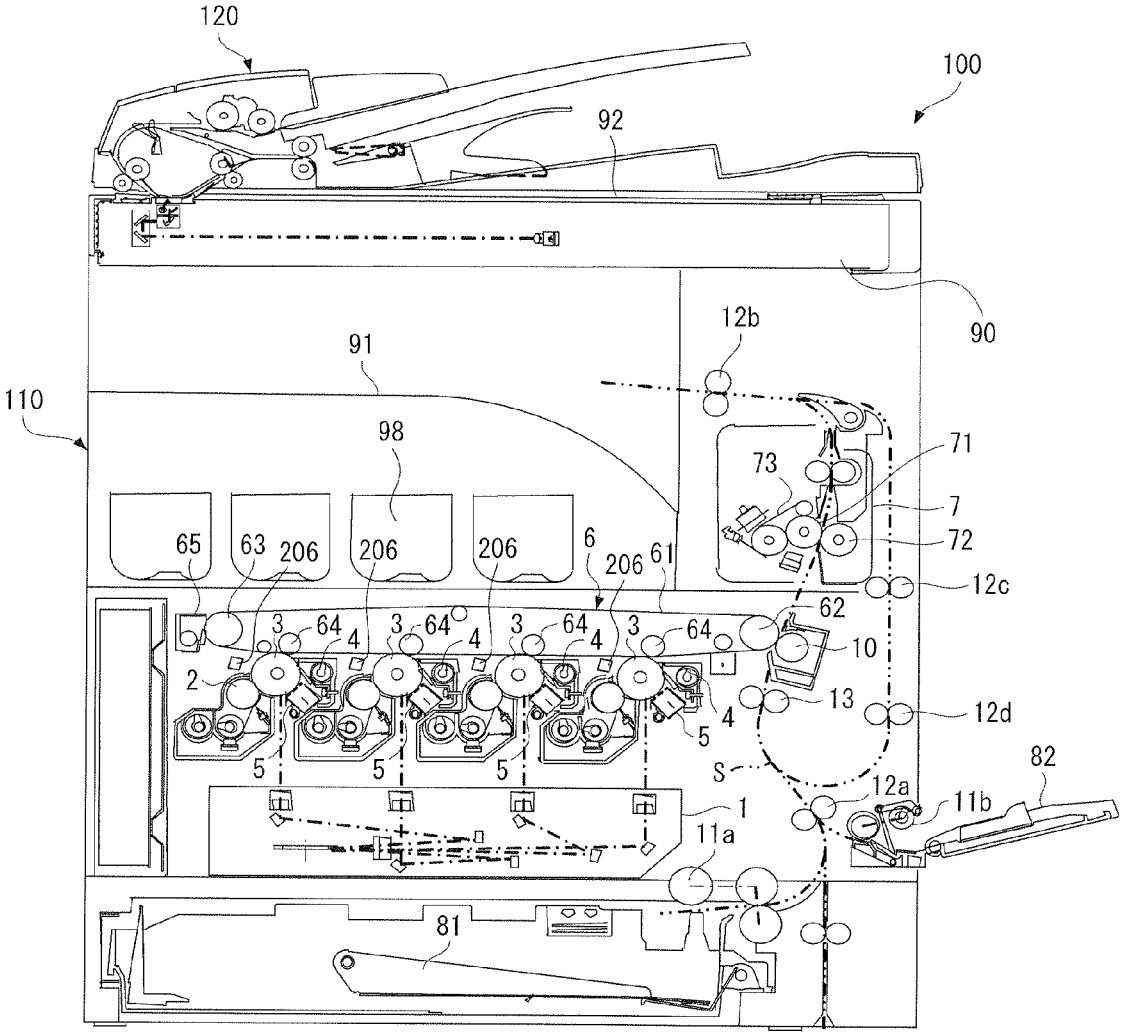
FIG. 1 is a longitudinal sectional view showing an overall arrangement of an image forming apparatus in accordance with an embodiment of the present invention.

FIG. 1 is a longitudinal sectional view showing an arrangement of an entire image forming apparatus 100 in accordance with the present embodiment.

The image forming apparatus 100 includes a main body apparatus 110 and an automatic document processing apparatus 120, as shown in FIG. 1. The main body apparatus 100 causes formation of a multi-colored or single-colored image on a recording sheet, based on image data externally inputted or image data obtained by reading a document.

The main body apparatus 110 includes an exposure unit 1, developing apparatuses 2, photoreceptor drums 3, cleaner units 4, chargers 5, an intermediate transfer belt unit 6, a fixing unit 7, a paper feed cassette 81, a paper output tray 91, and toner cartridges 98.

An image readout section 90 is provided on an upper part of the main body apparatus 110. A platen glass (i.e., scanner platen) 92 is provided above the image readout section 90. The automatic document processing apparatus 120 is attached to above the platen glass 92. The automatic document processing apparatus 120 automatically feeds a document onto the platen glass 92.

Image data that is processed in the image forming apparatus 100 is image data corresponding to a color image composite of black (K), cyan (C), magenta (M), and yellow (Y). In view of this, there are provided four image forming stations that are allocated for the respective colors. With this, four latent images of the respective colors are formed. Each of the image forming stations includes a developing apparatus 2, a photoreceptor drum 3, a charger 5, and a cleaner unit 4.

The charger 5 uniformly charges a surface of the photoreceptor drum 3 with a given electric potential. The exposure unit 1 causes formation of an electrostatic latent image on a surface of the photoreceptor drum 3, based on the image data externally inputted or the image data obtained by reading the document. The developing apparatus 2 visualizes, by use of a corresponding one of four toners (Y, M, C, and K), the electrostatic latent image formed on the photoreceptor drum 3.

Figure 2:
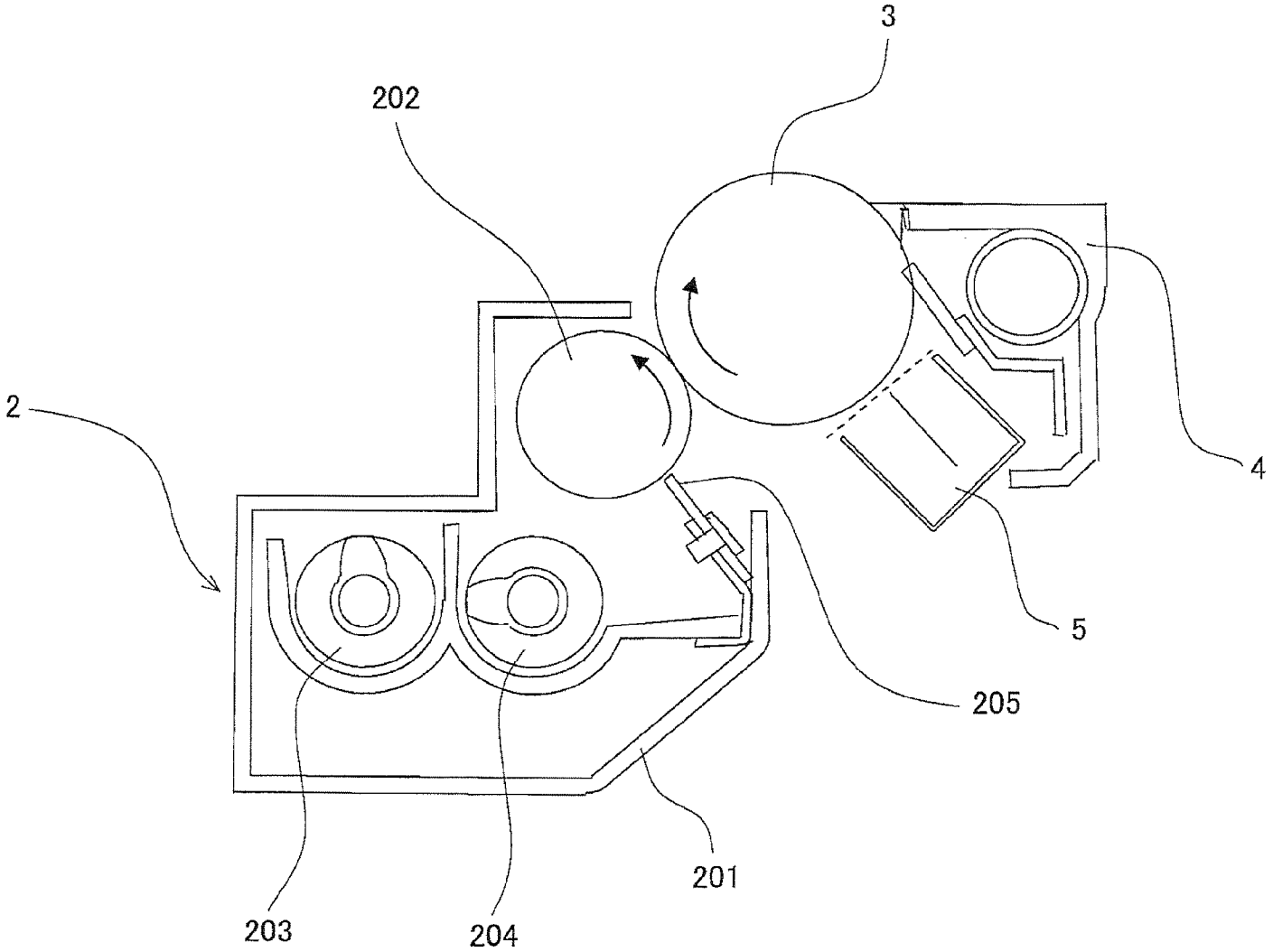
FIG. 2 is a longitudinal sectional view showing an arrangement of a developing device shown in FIG. 1 and an arrangement of a peripheral unit of the developing device.

FIG. 2 is a longitudinal sectional view showing an arrangement of the developing device 2 and arrangements of components provided near the developing device 2. As shown in FIG. 2, the developing device 2 includes a developing roller 202, stirring rollers 203 and 204, and a doctor blade 205 which are provided inside a developing tank 201 for containing a toner. The developing roller 202 supplies the toner to the photoreceptor drum 3 and thereby causes visualization of the electrostatic latent image formed on the surface of the photoreceptor drum 3. The stirring rollers 203 and 204 stir a developer, including the toner, which is contained in the developing tank 201. The doctor blade 205 controls an amount of the toner (i.e., toner amount) that is supplied to the photoreceptor drum 3 from the developing roller 202.

The photoreceptor drum 3 has a cylindrical shape and is provided above the exposure unit 1. A surface of the photoreceptor drum 3 is cleaned by the cleaner unit 4, and uniformly charged with the given electric potential by the charger 5. The cleaner unit 4 removes and collects a residual toner that is left on the surface of the photoreceptor drum 3 after image transfer.

As shown in FIG. 1, the intermediate transfer belt unit 6 is provided above the photoreceptor drum 3 and includes an intermediate transfer belt 61, an intermediate transfer belt driving roller 62, an intermediate transfer belt driven roller 63, intermediate transfer rollers 64, and an intermediate transfer belt cleaning unit 65.

The toner images of the respective colors formed on the respective photoreceptor drums 3 are transferred onto the intermediate transfer belt 61 one after another, so as to form an overlapping toner image. The image transfer of the toner images from the photoreceptor drums 3 to the intermediate transfer belt 61 is caused by the intermediate transfer rollers 64.

The overlapping toner image formed on the intermediate transfer belt 61 is (i) fed to a transfer location defined between the intermediate transfer belt 61 and the transfer roller 10, and (ii) transferred onto a paper.

According to this transfer process, the toners which have adhered to the intermediate transfer belt 61 and the residual toners which have been left on the intermediate transfer belt 61 are removed and collected by the cleaning unit 65.

Photosensors (density sensors) 206 are provided near the intermediate transfer belt 61 so as to closely face an outer surface of the intermediate transfer belt 61. The photosensors 206 detect image densities of toner patch images that are transferred onto the intermediate transfer belt 61 within the process control (i.e., image density adjustment operation).

The paper feeding cassette 81 is provided below the exposure unit 1 of the main body apparatus 110. A manual paper feeding cassette 82 is provided to an outer part of the main body apparatus 110. The paper output tray 91 is provided in the upper part of the main body apparatus 110.

The main body apparatus 110 has a paper carrying path S on which both a paper stored in the paper feeding cassette 81 and a paper stored in the manual paper feeding cassette 82 can be sent to the paper output tray 91 via the transfer roller 10 and the fixing unit 7. The following members (i) to (v), etc. are provided near the paper carrying path S; (i) pickup rollers 11*a* and 11*b*, (ii) a plurality of carrying rollers 12*a* to 12*d*, (iii) registration rollers 13, (iv) the transfer roller 10, and (v) the fixing unit 7.

The fixing unit 7 includes a heat roller 7 and a pressure roller 72 that serve as fixing rollers.

Figure 3:
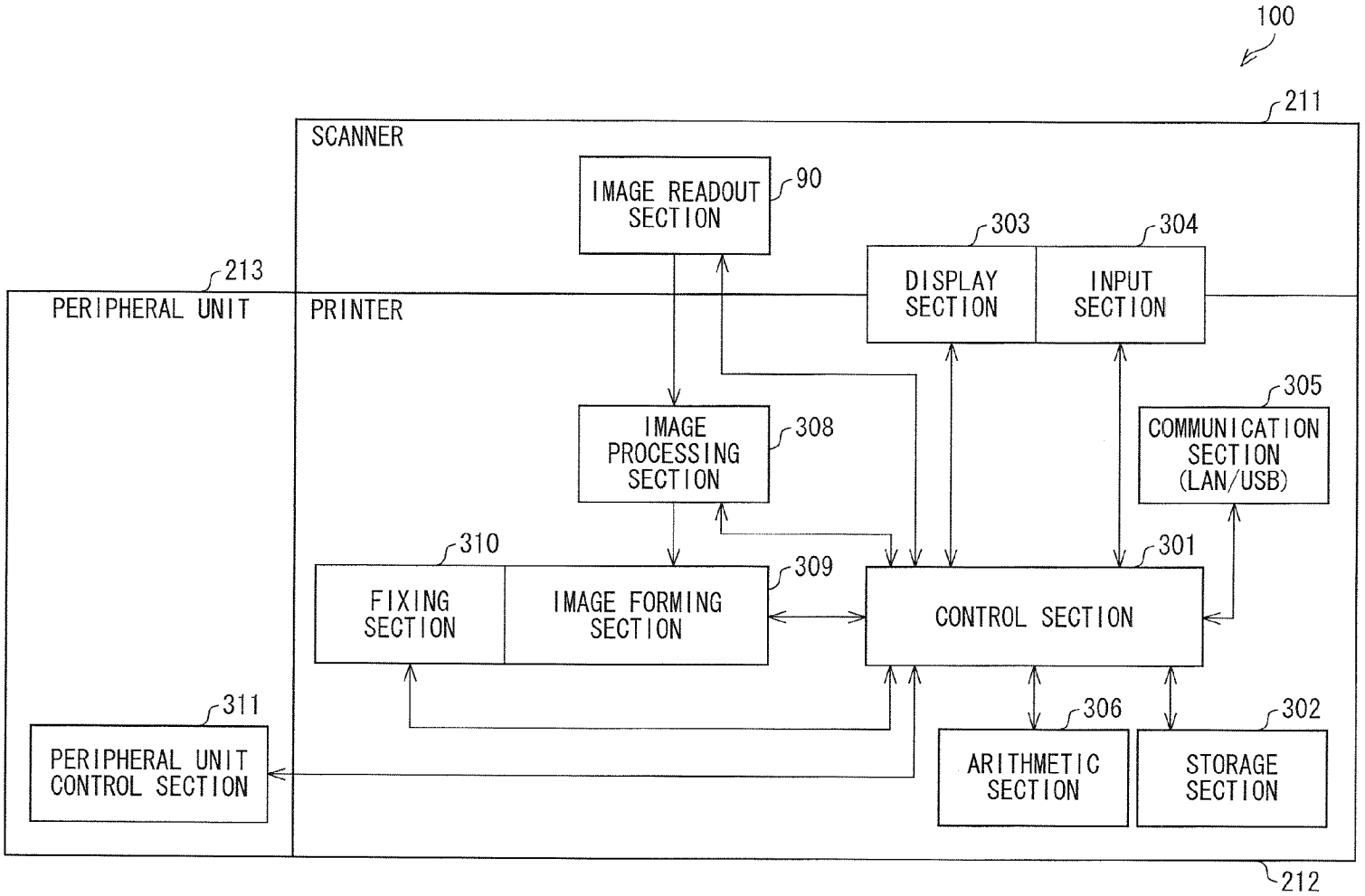
FIG. 3 is a block view showing, on a functional basis, the arrangement of the image forming apparatus shown in FIG. 1.

FIG. 3 is a block view showing, on a function basis, the arrangement of the image forming apparatus 100 shown in FIG. 1.

The image forming apparatus 100 is a multifunction printer including a scanner 211, a printer 212, and a peripheral unit 213, for example (see FIG. 3). As shown in FIG. 3, the image forming apparatus 100 includes a control section 301, a storage section 302, a display section 303, an input section 304, a communication section 305, an arithmetic section 306, a readout section 307, an image processing section 308, an image forming section 309, a fixing section 310, and a peripheral unit control section 311.

The scanner 211 is formed by the automatic document processing apparatus 120 and the image readout section 90 that are shown in FIG. 1.

The printer 212 includes the control section 301, the storage section 302, the communication section 305, the arithmetic section 306, the image processing section 308, the image forming section 309, and the fixing section 310.

The control section 301 controls an operation of the image forming apparatus 100. In order for the control section 301 to do so, the following (i) to (v), etc are inputted to the control section 301; (i) a print request given via an operation panel (i.e., the display section 303 and the input section 304), (ii) detection results received from various sensors (which are not shown) provided inside the image forming apparatus 100, etc., (iii) image information inputted via an external unit (i.e., a USB memory or LAN) (which is not shown), (iv) various preset values and data tables for controls of operations of various apparatuses provided inside the image forming apparatus 100, and (v) programs for execution of various controls. The external unit is an electric/electronic unit, e.g., a computer, a digital camera, etc., which is (i) capable of creating or obtaining the image information and (ii) electrically connectable with the image forming apparatus 100.

The control section 301 and the arithmetic section 306 are process circuits each realizable by a microcomputer including a central processor unit (CPU), a microprocessor including a central processor unit (CPU), etc., for example.

The storage section 302 is formed by a ROM, a RAM, a hard disk drive (HDD), etc., for example. The display section 303 and the input section 304 correspond to the operation panel that is provided on an upper side of the image forming apparatus 100. The communication section 305 communicably connects the image forming apparatus 100 with the external unit, i.e., a PC, etc., via a network line (i.e., LAN connection, etc.).

The arithmetic section 306 performs various detections and/or judgments by fetching, from the storage section 302, the various data (i.e., the print request, the detection results, the image information, etc.) and (ii) the programs for execution of various controls. The control section 301 performs operation control by sending a control signal to a corresponding apparatus in accordance with various judgment results and computation results obtained by the arithmetic section 306. The image processing section 308 creates image data by converting, into a suitable electric signal, a document image that has been read out by the image readout section 90.

The image data created by the image processing section 308 is (i) visualized with the use of the toners and transferred onto a transfer paper, by the image forming section 309. The image forming section 309 includes the exposure unit 1, the developing apparatuses 2, the photoreceptor drums 3, the cleaner units 4, the chargers 5, the intermediate transfer belt unit 6, the photosensors 206, and a power source section for supplying power to these constituents of the image forming section 309. A toner image that has been visualized by the image forming section 309 is fixed, by heat fusing, onto the transfer paper by the fixing section 310. The fixing section 310 includes the fixing unit 7 and a power source section for supplying power to the fixing unit 7.

The peripheral unit 213 is formed by a component that serves as a post-processing apparatus, i.e., a finisher, a sorter, etc. The peripheral unit 213 includes the peripheral unit control section 311 that controls the peripheral unit 213.

In the image forming apparatus 100, the image density is fluctuated depending on a change in an environment condition around the image forming apparatus 100, weariness of the photoreceptor drums 3 and the developers, etc. In view, the image forming apparatus 100 is arranged such that process control for adjusting the image density is performed (i) every predetermined number of sheets to which printing is performed or (ii) in response to the change in the environment condition such as a temperature, a humidity, etc.

Figure 4:
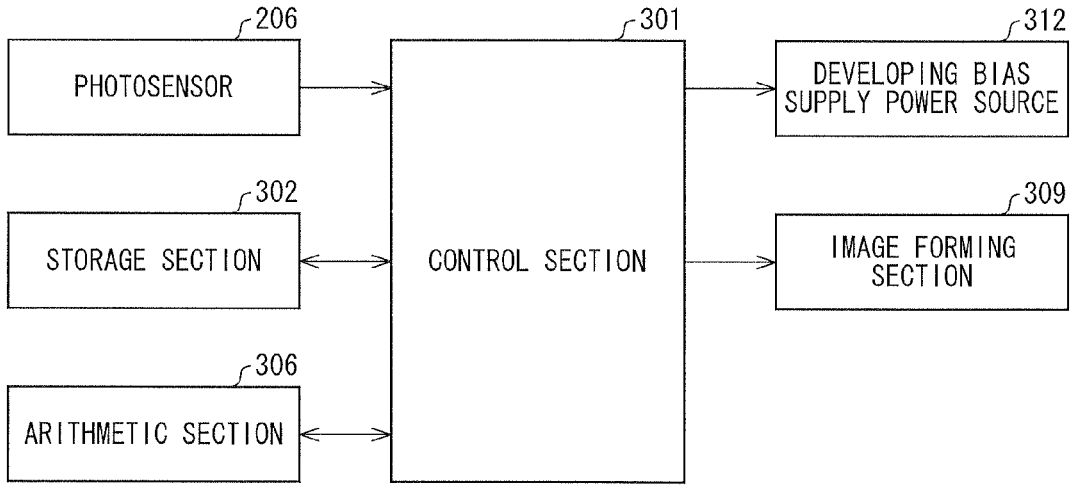
FIG. 4 is a block view showing arrangements in the image forming apparatus shown in FIG. 1 which arrangements are provided for performing process control.

FIG. 4 is a block view showing arrangements in the image forming apparatus 100 which arrangements are provided for performing the process control. A developing bias supply power source 312 is a power source for supplying a developing bias to the developing roller 202 of the developing apparatus 2. The developing bias supply power source 312 is capable of changing the developing bias in response to the control by the control section 301.

When the process control is performed, a plurality of toner patches having different densities are formed on the surface of the photoreceptor drum 3 by changing the developing bias being supplied to the developing roller 202. In the present embodiment, the plurality of toner patches formed on the photoreceptor drum 3 are transferred onto the intermediate transfer belt 61, and their densities are detected by the photosensor 206. Alternatively, the photodetector 206 may detect the densities of the plurality of toner patches on the surface of the photoreceptor drum 3. The plurality of toner patches having the different densities are visualized with the use of each toner color. It follows that the process control is performed with respect to each toner color.

A result of detection obtained by the photosensor 26 is inputted to the arithmetic section 306 via the control section 301. In response, the arithmetic section 306 calculates a reference developing bias DVB0 for a target image density, based on the result of detection inputted from the photoreceptor 206. Then, the arithmetic section 306 calculates a print-time developing bias DVBp that is a developing bias necessary to be set during a print job in the image forming apparatus 100. Both the reference developing bias DVB0 and the print-time developing bias DVBp are stored in the storage section 302. The control section 301 controls the developing bias supply power source 312 in such a manner that the print-time developing bias DVBp is supplied to the developing roller 202 during the print job in the image forming apparatus 100.

Figure 5:
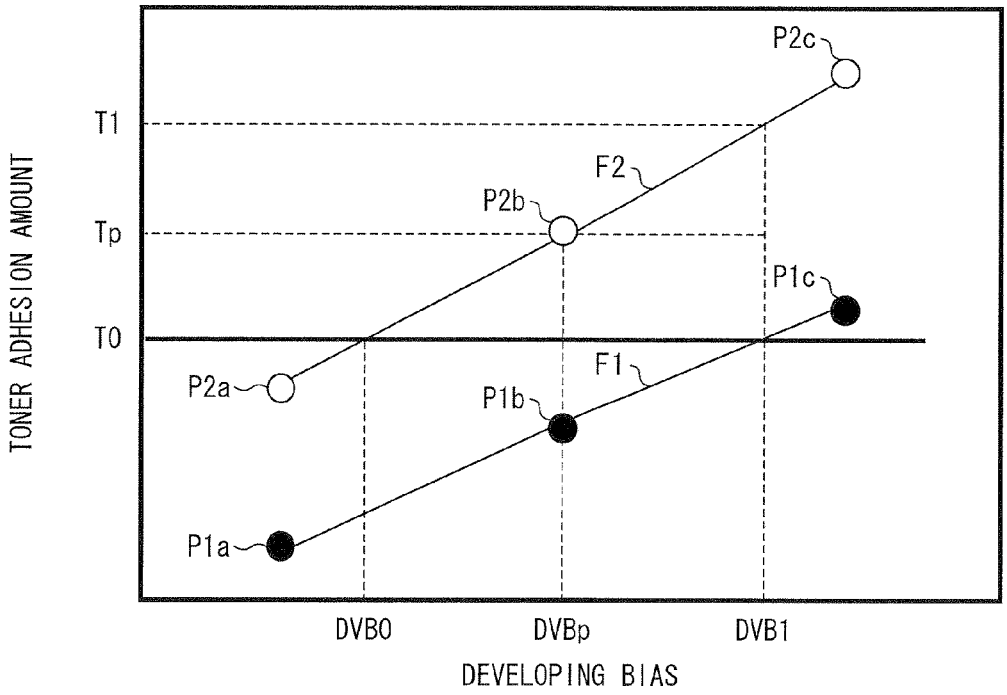
FIG. 5 shows graphs of relationships between a developing bias and a toner adhesion amount in a surface of a photoreceptor drum in the image forming apparatus shown in FIG. 1.

The following describes how the print-time developing bias is set by the control section 301. FIG. 5 shows graphs of a relationship between the developing bias and a toner adhesion amount on the surface of the photoreceptor drum 3.

In FIG. 5, F1 indicates a characteristic of the image forming apparatus 100 which characteristic has been obtained by previous process control. This characteristic of the image forming apparatus 100 is hereinafter referred to as a process control characteristic F1. F2 indicates a characteristic of the image forming apparatus 100 which characteristic is obtained by current process control. This characteristic of the image forming apparatus 100 is hereinafter referred to as a process control characteristic F2.

In the graph indicative of the process control characteristic F1, three filled circles P1*a*, P1*b*, and P1*c* are plotted to indicate respective toner patches that (i) are formed by applying respective different reference developing biases and (ii) have the different densities. Similarly, in the graph indicative of the process control characteristic F2, three open circles P2*a*, P2*b*, and P2*c* are plotted to indicate respective toner patches that (i) are formed by applying respective different reference developing biases and (ii) have different densities.

When it comes to developing biases DVB, DVB0 indicates the reference developing bias, DVBp indicates the print-time developing bias, and DVB1 indicates a print-time developing bias that has been set by the previous process control (hereinafter referred to as a previous print-time developing bias).

When it comes to toner adhesion amounts T, T0 indicates a reference toner adhesion amount obtained in response to the reference developing bias DVB0, Tp indicates a print-time setting toner adhesion amount obtained in response to the print-time developing bias DVBp, and T1 indicates a previous toner adhesion amount obtained in response to the previous print-time developing bias DVB1.

The reference toner adhesion amount T0 is a toner adhesion amount for the target image density in the image forming apparatus 100. It follows that the target image density is obtained in response to the reference developing bias DVB0. The print-time setting toner adhesion amount Tp is set by the current process control in the image forming apparatus 100 and is a toner adhesion amount for a print-time image density (hereinafter referred to as a current print-time setting image density). It follows that the current print-time setting image density is obtained in response to the print-time developing bias DVBp. The previous toner adhesion amount T1 is set by the previous process control in the image forming apparatus 100 and is a toner adhesion amount for a print-time image density (hereinafter referred to as a previous print-time setting image density). It follows that the previous print-time setting image density is obtained in response to the previous print-time developing bias DVB1.

In order for working out the reference developing voltage DVB0, the arithmetic section 306 first works out the process control characteristic F2, based on the toner adhesion amounts for the respective three respective toner patches P2*a*, P2*b*, P1*c* shown in FIG. 5. Then, the arithmetic section 306 works out the reference developing bias DVB0 by finding a developing bias DVB corresponding to an intersection of (i) the straight line graph indicative of the process control characteristic F2 and (ii) a straight line graph of the reference toner adhesion amount T0. The reference developing bias DVB0 can therefore work out the reference developing bias DVB0 for the target image density.

Then, the arithmetic section 306 calculates the print-time developing bias DVBp by the following equation (1), by using the reference developing bias DVB0, the previous print-time developing bias DVB1, and a coefficient k;

$$DVBp=(DVB0-DVB1)\times k+DVB1 \quad (1).$$

In the equation (1), the pervious print-time developing bias DVB1 is a reference developing bias DVB0 that has been set by the previous process control.

A value of the coefficient k is set within a range of $0<k\leq 1$. FIG. 6 is a table showing selection conditions of the value of the coefficient k. In an example shown in FIG. 6, the coefficient k is set within a range of $0.5<k\leq 1$.

As shown in FIG. 6, the coefficient k is changed in accordance with the previous print-time developing bias DVB1 in such a manner that the greater the previous print-time developing bias DVB1 is, the greater the coefficient k is. Specifically, in a case where the previous print-time developing bias DVB1 falls within a range of greater than 0 V and less than 400 V, the coefficient k is set in such a manner that the greater the previous print-time developing bias DVB1 is, the greater the coefficient k is. On the other hand, in a case where the previous print-time developing bias DVB1 falls within a range of 400 V or greater and less than 600 V, the coefficient k is set to 1.

Also, the coefficient k is changed depending on an absolute value of a difference between the reference developing bias DVB0 and the previous print-time developing bias DVB1 (|DVB0−DVB1|(V)) in such a manner that the greater the absolute value of the difference between the reference developing bias DVB0 and the previous print-time developing bias DVB1 is, the greater the coefficient k is. Specifically, in a case where (i) the previous print-time developing bias DVB1 falls within the range of greater than 0 V and less than 400 V and (ii) the absolute value of the difference between the reference developing bias DVB0 and the previous print-time developing bias DVB1 falls within a range of greater than 40 V, the coefficient k is set in such a manner that the greater the absolute value of the difference between the reference developing bias DVB0 and the previous print-time developing bias DVB1 is, the greater the coefficient k is.

In the present embodiment, the coefficient k is set to 1 in a case where the previous print-time developing bias DVB1 falls within the range of 400 V or greater and less than 600 V. This is based on the following reasons.

Figure 7:
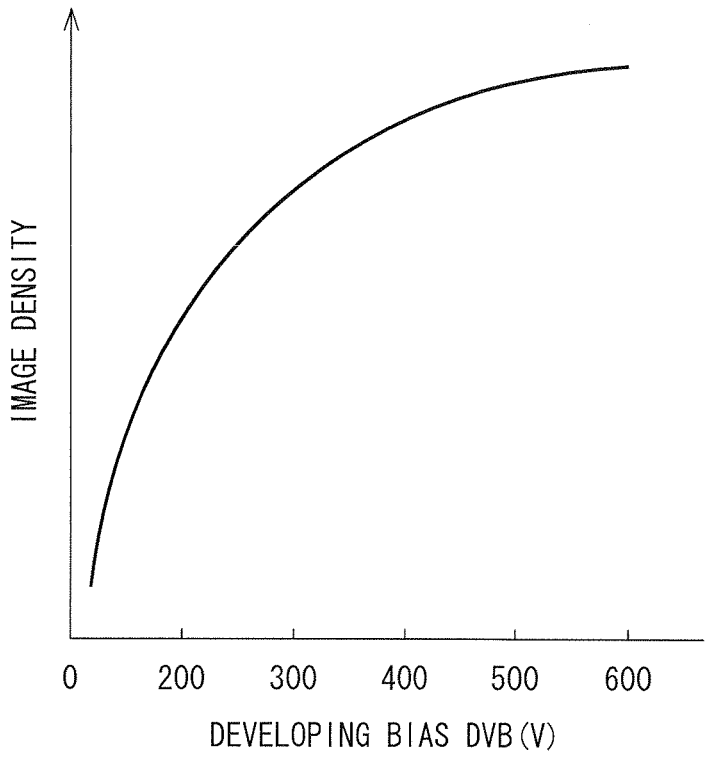
FIG. 7 is a graph of a relationship between a developing bias and an image density in the image forming apparatus shown in FIG. 1.

FIG. 7 shows a graph of a relationship between a developing bias DVB and an image density. As shown in FIG. 7, the image density is increased in response to an increase in the developing bias DB. However, in a case where the developing bias DVB falls within the range of 400 V or greater and less than 600 V and is thereby high, a ratio of the increase in the image density to the increase in the developing bias is small. As such, in a case where the developing bias DVB0 falls within this range, the image density is changed less significantly between before and after the process control even if the reference developing bias DVB0 is directly set as the print-time developing bias DBp. On this account, in a case where the developing bias DVB falls within the range of 400 V or greater and less than 600 V and is thereby high, the coefficient k is set to 1.

Therefore, in the example, in a case where the previous print-time developing bias DVB1 falls within at least a low range (i.e., a range that a ratio of a change in the image density to a change in the developing bias DVB is great), the coefficient k is set within the range of $0<k<1$ (alternatively, $0.5<k<1$).

As described above, the coefficient k is set to 1 in a case where the previous print-time developing bias DVB1 falls within the range of 400 V or greater and less than 600 V, i.e., the range that the ratio of the change in the image density to the change in the developing bias DVB is small. This can simplify the controlling of the developing bias DVB. However, the present embodiment is not limited to this. Instead of being set to 1, the coefficient k may be set to a value of less than 1 even in a case where the previous print-time developing bias DVB1 falls within the range of 400 V or greater and less than 600 V.

Figure 8:
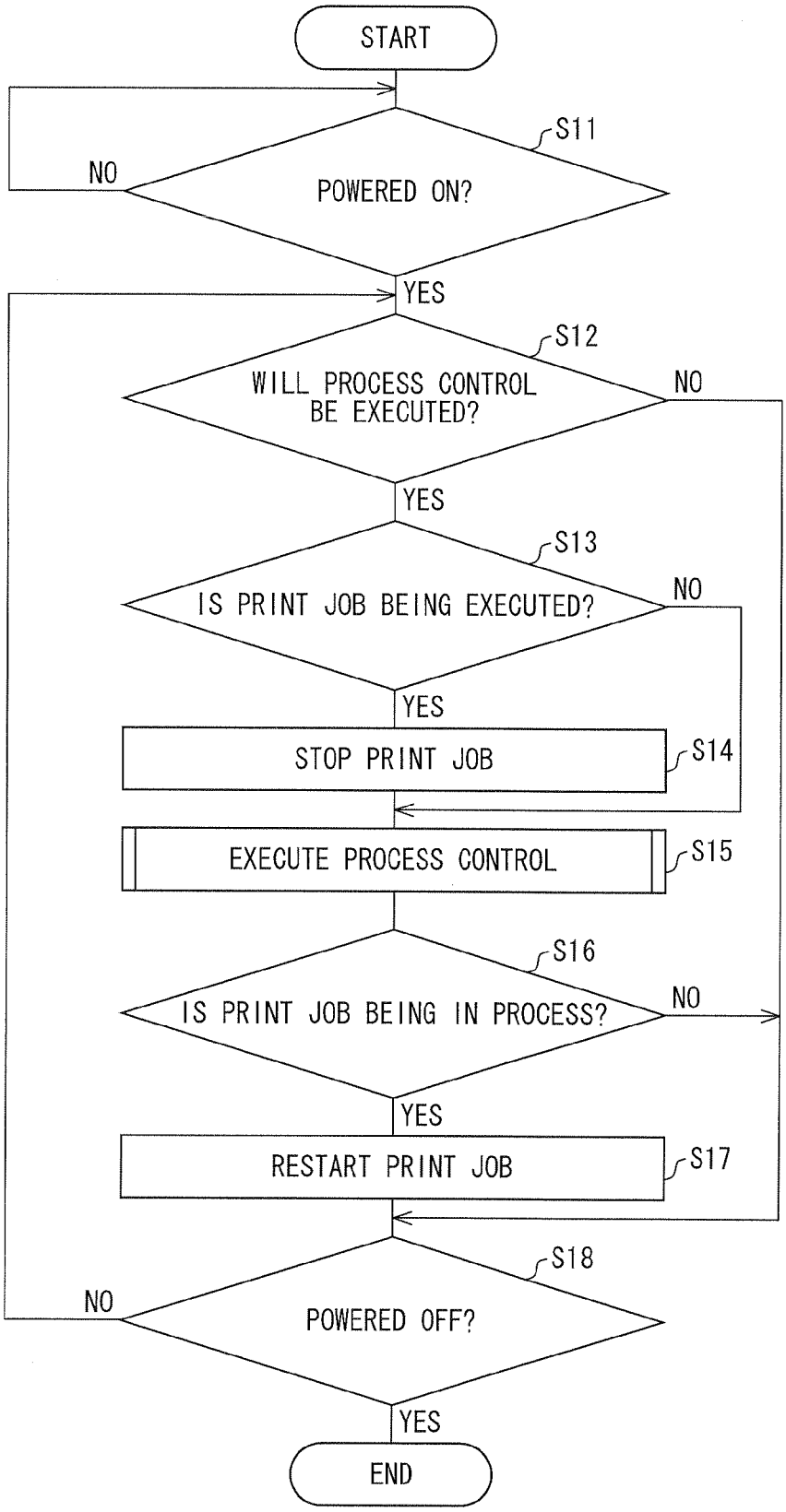
FIG. 8 is a flow chart showing operations in a process control performed in the image forming apparatus shown in FIG. 1
Figure 9:
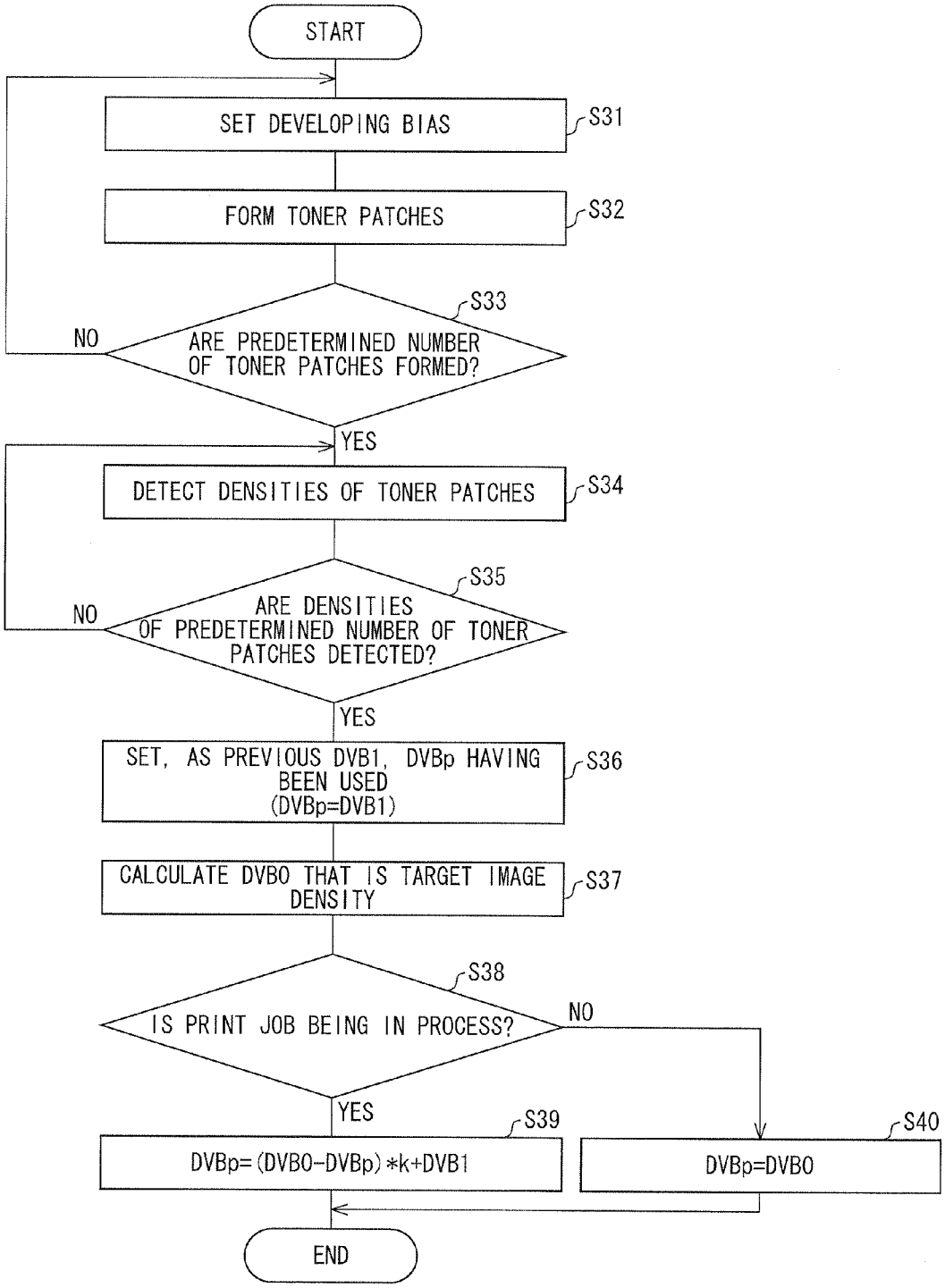
FIG. 9 is a flow chart showing contents of the operation in S15 shown in FIG. 8.

The following describes how the image forming apparatus 100 with the arrangement operates when it performs the process control (i.e., the image density adjustment operation). FIG. 8 is a flow chart showing how the image forming apparatus 100 operates when it performs the process control. FIG. 9 is a flow chart showing the contents of the operation in S15 shown in FIG. 8.

After the image forming apparatus 100 is powered on (S11), the control section 301 determines whether it is necessary to execute the process control or not (S12). The control section 301 determines that it is necessary to execute the process control, when either condition (i) or is met, for example: (i) the number of sheets, to which image printing is performed in the image forming apparatus 100 after the previous process control, reaches a predetermined number, and (ii) the change in the environment condition such as a temperature, a humidity, etc. reaches or exceeds a predetermined value. Which of the conditions (i) and (ii) is selected is determined based on settings of the image forming apparatus 100.

If it is determined in S12 that it is not necessary to execute the process control, then a process advances to S18. Thereafter, if it is determined in S18 that the image forming apparatus 100 is powered off, then the process is ended.

In contrast, if it is determined in S12 that it is necessary to execute the process control, then it is determined whether a print job is being performed or not (S13). If the print job is being performed, then the print job is stopped (S14), and the process control is performed (S15). In contrast, if it is determined in S13 that no print job is being performed, then the process advances to S15. In S15, the process control is executed.

Then, in a case where the print job has been stopped in S14, it is restarted (S17) after the process control in S15, and finished. Thereafter, when the image forming apparatus 100 is powered off (S18), the process is ended. In contrast, if the image forming apparatus 100 is not powered off, then the process returns to S12.

The following describes the contents of the process control in S15.

When the process control is carried out, the control section 301 sets developing biases for toner patches by controlling the developing bias supply power source 312 (S31). Then, the toner patches are formed on the photoreceptor drum 3 in response to the developing biases thus being set (S32).

Then, the control section 301 determines whether the predetermined number of toner patches have been formed or not (S33). If it is determined that they have not been formed, then the operations in S31 and S32 are repeated until the predetermined number of toner patches are formed. In an example shown in FIG. 9, the developing biases for the respective toner patches are set to be different from each other in S31. In the present embodiment, the number of toner patches for each color is three, as shown in FIG. 3.

Then, densities of the toner patches are detected by the photosensor 206 (S34 and S35), and results of detection are stored in the storage section 302.

Then, the print-time developing bias DVBp which has been used before the current process control is set as the previous print-time developing bias DVB1 (S36).

Then, the arithmetic section 306 works out (i) the process control characteristic F2, based on the results of detection obtained in S34 and S35, and (ii) the reference developing bias DVB0 for the target image density, based on the process control characteristic F2 and the reference toner adhesion amount T0, as explained in FIG. 5 (S37).

Then, the arithmetic section 306 determines whether the print job is being executed or not (S38). In a case where the print job is being executed, the arithmetic section 306 calculates the print-time developing bias DVBp by the equation (1). In contrast, in a case where no print job is being executed during S38, the reference developing bias DVB0 worked out in S37 is set as the print-time developing bias DVBp (S40).

Thereafter, the control section 301 ensures that the print-time developing bias DVBp worked out by the arithmetic section 306 is used as the developing bias DVB in image printing until next process control.

In the image forming apparatus 100 of the present embodiment, the process control is performed so that the print-time developing bias DVBp is set to a value between (i) the reference developing biases DVB0 for the target image density and (ii) the previous print-time developing bias DVB1. As such, it is possible to decrease an image density change between (i) an image printed on a page before the process control and an image printed on a next page after the process control, as compared with a case that the reference developing bias DVB0 which has been worked out is directly used as the print-time developing bias DVBp. This makes is possible to (i) obtain an image density close to the target image density and (ii) prevent occurrence of a situation that the image density is significantly changed between before and after the process control so that the pages cause discomfort in a reader.

The step of determining whether it is necessary to perform the process control or not (see FIG. 8) may be arranged so as to perform the following (i) and (ii) while the print job is being performed; (i) determining whether the print job is (a) a high or low coverage rate print job or (b) a medium coverage rate print job and (ii) causing the process control in a case where the process control is the high coverage rate print job or the low coverage rate print job.

The process in which the arithmetic section 306 determines whether the print job is the high or low coverage rate print job or the medium coverage rate print job may be arranged as follows by employing a well known art; whether the print job is the high or low coverage rate print job or the medium coverage rate print job is determined by (i) adding up the number of pixels of images that are formed on the respective photoreceptor drums 3 within one print job and (ii) comparing a result obtained by the addition (i) with a predetermined value.

In this case, the arithmetic section 306 determines whether the print job is the high or low coverage rate print job or the medium coverage rate print job, as described above. Then, in a case where (i) the process control is performed while the print job is being executed and (ii) the print job is the high coverage rate print job or the low coverage rate print job, the arithmetic section 306 determines the print-time developing bias DVBp within a range between the reference developing bias DVB0 and the previous print-time developing bias DVB1.

In a case where the print job is the high coverage rate print job or the low coverage rate print job, there is a problem that when an image density is changed, a change in the image density is easily noticeable. However, the arrangement decreases such an image density change between an image printed on a page before the process control and an image printed on a next page after the process control. As such, it is possible to prevent as appropriate occurrence of a situation that the image density is greatly changed between before and after the process control so that the images on the pages cause discomfort in a reader.

Embodiment 2

Another embodiment of the present invention is described below with reference to figures.

In an image forming apparatus 100 of the present embodiment, an arithmetic section 306 determines a print-time developing bias DBVp by a process in S39 or S40, similarly to the case in Embodiment 1.

If this process in the process control sets, by calculating an equation (1) early described, the print-time developing bias DVBp to a value between (i) a reference developing bias DVB0 for a target image density and (ii) a previous developing time bias DVB1, instead of setting it to the reference developing bias DVB0, then the print-time developing bias DVBp is modified, at least one time after the process control and before a next process control, in a direction approaching the reference developing bias DVB0.

The print-time developing bias DVBp may be modified as such so as to be closer to the reference developing bias DVB0, as compared with the print-time developing bias before modification, or so as to be set to the reference developing bias DVB0. It is preferable that the print-time developing bias DVBp is modified two or more times so as to be gradually close to the reference developing bias DVB0.

Figure 10:
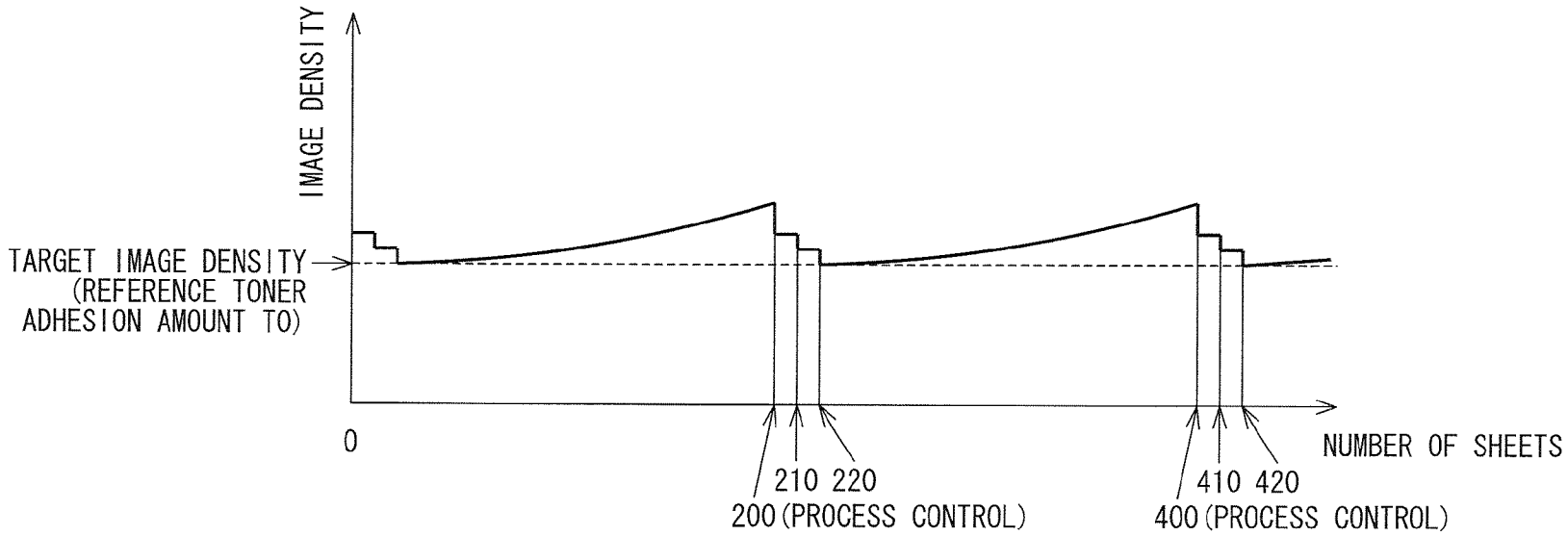
FIG. 10 is a graph of a relationship between the number of printed sheets and an image density in an image forming apparatus in accordance with another embodiment of the present invention, which relationship is obtained in a case where (i) process control is performed every predetermined numbers of printed sheets and (ii) a process of modifying a print-time developing bias is performed after each process control.

FIG. 10 shows a graph of a relationship between the number of printed sheets and an image density in the image forming apparatus 100 of the present embodiment, which relationship is obtained in a case where (i) the process control is performed every predetermined number of printed sheets and (ii) the print-time developing bias DVBp is modified after each process control.

In an example shown in FIG. 10, the process control is performed every two hundred sheets to which printing is performed in the image forming apparatus 100. Also, the print-time developing bias DVBp that has been set by the process control is firstly modified after image printing is performed with respect to ten sheets, and again modified after image printing is performed with respect to twenty sheets.

Specifically, in the example shown in FIG. 10, the print-time developing bias DVBp is set by the process control in such a manner that the image density is changed to an intermediate image density between (i) an image density obtained immediately before the process control and (ii) the target image density. Then, after the image printing is performed with respect to ten sheets after the process control, the print-time developing bias DVBp is modified by a first modification process in such a manner that the image density is changed to an intermediate image density between (i) an image density obtained immediately after the process control and (ii) the target image density. Then, after the image printing is performed with respect to twenty sheets after the process control, the print-time developing bias DVBp is again modified by a second modification process in such a manner that the image density is changed to the target image density. In this case, the print-time developing bias DVBp is set to the reference developing bias DVB0.

Figure 11:
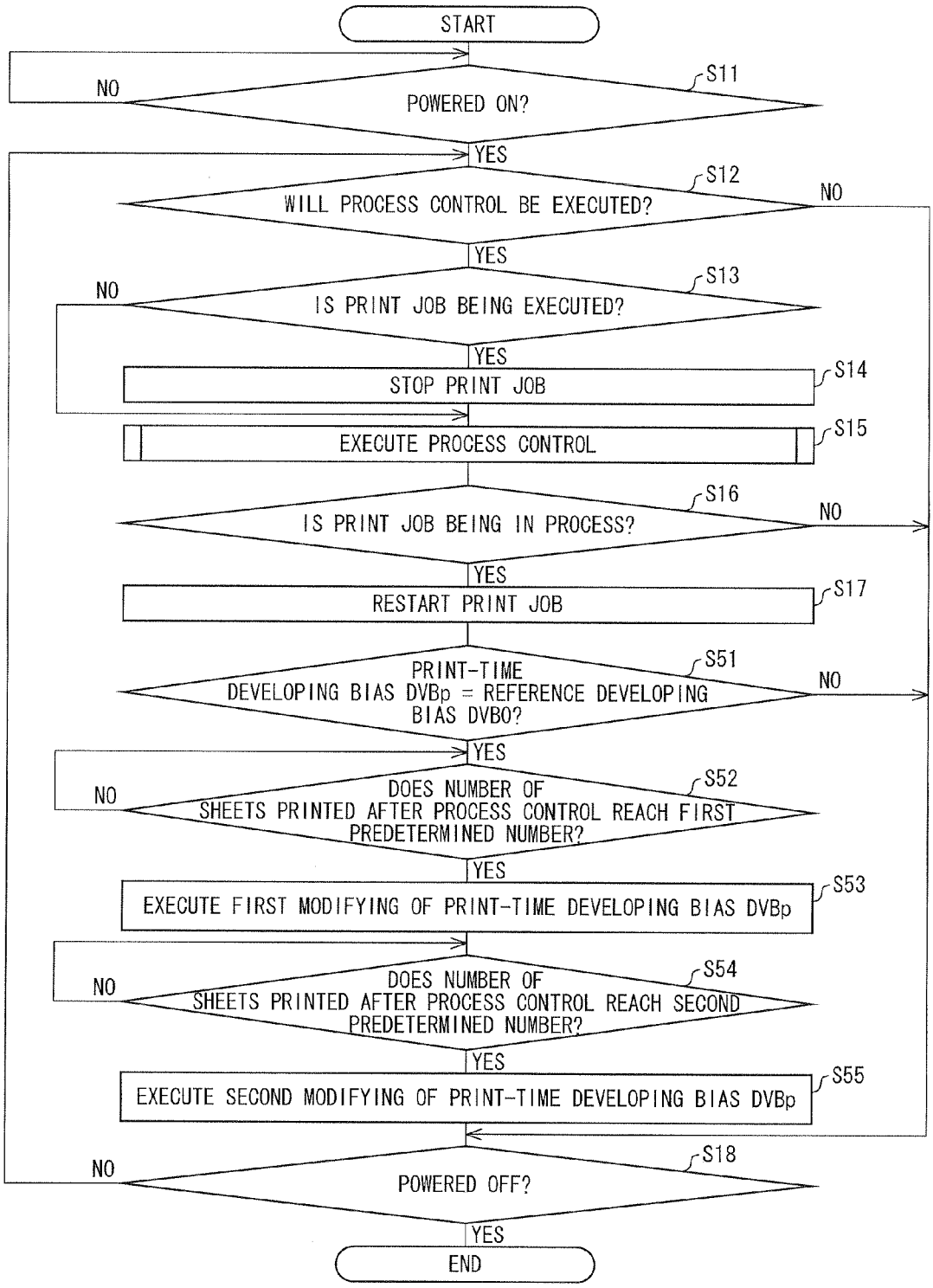
FIG. 11 is a flow chart showing operations in the image forming apparatus in accordance with another embodiment of the present invention, which operations are performed when the process of modifying the print-time developing bias is performed after the process control.

The following describes how the image forming apparatus 100 of the present embodiment operates in the arrangement. FIG. 11 is a flow chart showing how the image forming apparatus 100 operates when it performs the first and second modification processes after the process control.

Processes in S11 to S17 and S18 shown in FIG. 11 are same as the processes in S11 to S17 and S18 shown in FIG. 8. After the process control (S15), a control section 301 determines whether a print job is being executed or not (S16). In a case where the print job is temporality stopped in the midst of execution, the control section 301 restarts the print job (S17).

Thereafter, the control section 301 determines whether the process control has set the print-time developing bias DVBp to the reference developing bias DVB0 for the target image density or not (S51). If it is determined that the process control has set the print-time developing bias DVBp to the reference developing bias DVB0, then a process advances to S18.

In contrast, if it is determined in S51 that the process control has not set the print-time developing bias DVBp to the reference developing bias DVB0 yet, i.e., the print-time developing bias DVBp has been set to the value between the reference developing bias DVB0 and the previous print-time developing bias DVB1, then it is determined whether the number of sheets to which image printing is performed after the process control reaches a first predetermined number (e.g., ten sheets) or not (S52).

Then, in a case where it is determined that the number of sheets to which the image printing is performed after the process control reaches the first predetermined number (e.g., ten sheets), the control section 301 causes the first modification process to the print-time developing bias DVBp (S53). According to the first modification process, the print-time developing bias DVBp is modified so as to be close to the reference developing bias DVB0. Specifically, the print-time developing bias DVBp is set to the value (e.g., the intermediate value) between (i) the print-time developing bias DVBp that has been set in the process control and (ii) the reference developing bias DVB0.

Then, the control section 301 determines whether or not the number of sheets to which the image printing is performed after the process control reaches a second predetermined number (e.g., twenty sheets) greater than the first predetermined number (S54).

Then, in a case where it is determined that the number of sheets to which the image printing is performed after the process control reaches the second predetermined number (e.g., twenty sheets), the control section 301 causes the second modification process to the print-time developing bias DVBp (S55). According to the second modification process, the print-time developing bias DVBp is modified so as to be further closer to the reference developing bias DVB0, as compared with the first modification process. Alternatively, the print-time developing bias DVBp is set to the reference developing bias DVB0.

In the image forming apparatus 100 of the present embodiment, the process control sets the print-time developing bias DVBp to the value between (i) the reference developing bias DVB0 for the target image density and (ii) the previous print-time developing bias DVB1, as described above. As such, it is possible to reduce an image density change between an image printed on a page before process control and an image printed on a next page after the process control, as compared with a case that the reference developing bias DVB that has been worked out is directly used as the print-time developing bias DVBp. This makes it possible to (i) obtain an image density close to the target image density and (ii) prevent occurrence of a situation that the image density is significantly changed between before and after the process control so that the images on the pages causes discomfort in a reader.

Also, in a case where the process control sets the print-time developing bias DVBp to the value between (i) the reference developing bias DVB0 for the target image density and (ii) the previous print-time developing bias DVB1, the print-time developing bias DVBp is modified at least one time after the process control and before next process control. According to this modification process, the print-time developing bias DVBp is modified in the direction approaching the reference developing bias DVB0 for the target image density. This makes it possible to (i) prevent the occurrence of the situation that the image density is significantly changed between before and after the process control so that the images on the pages cause discomfort in the reader and (ii) obtain the image density close to the target image density or an image density identical to the target image density.

Finally, the blocks of the image forming apparatus 100, i.e., the control section 301 and the arithmetic section 306 in particular, may be realized by way of hardware or software as executed by a CPU as follows.

The image forming apparatus 100 includes a CPU (central processing unit) and memory devices (memory media). The CPU (central processing unit) executes instructions in control programs realizing the functions. The memory devices include a ROM (read only memory) which contains programs, a RAM (random access memory) to which the programs are loaded, and a memory containing the programs and various data. The objective of the present invention can also be achieved by mounting to the image forming apparatus 100 a computer-readable storage medium containing control program code (executable program, intermediate code program, or source program) for the image forming apparatus 100, which is software realizing the aforementioned functions, in order for the computer (or CPU, MPU) to retrieve and execute the program code contained in the storage medium.

The storage medium may be, for example, a tape, such as a magnetic tape or a cassette tape; a magnetic disk, such as a Floppy (Registered Trademark) disk or a hard disk, or an optical disk, such as CD-ROM/MO/MD/DVD/CD-R; a card, such as an IC card (memory card) or an optical card; or a semiconductor memory, such as a mask ROM/EPROM/EEPROM/flash ROM.

The image forming apparatus 100 may be arranged to be connectable to a communications network so that the program code may be delivered over the communications network. The communications network is not limited in any particular manner, and may be, for example, the Internet, an intranet, extranet, LAN, ISDN, VAN, CATV communications network, virtual dedicated network (virtual private network), telephone line network, mobile communications network, or satellite communications network. The transfer medium which makes up the communications network is not limited in any particular manner, and may be, for example, wired line, such as IEEE 1394, USB, electric power line, cable TV line, telephone line, or ADSL line; or wireless, such as infrared radiation (IrDA, remote control), Bluetooth (registered trademark), 802.11 wireless, HDR, mobile telephone network, satellite line, or terrestrial digital network. The present invention is realizable in form of a computer data signal embedded in a carrier wave in which computer data signal the program code is embodied electronically.

The image forming apparatus may be arranged so that the arithmetic section calculates the print-time developing bias by the following equation:

$$DVBp=(DVB0-DVB1)\times k+DVB1,$$

where DVBp is the print-time developing bias, DVB0 is the reference developing bias, DVB1 is the previous print-time developing bias, k is a coefficient, wherein the coefficient k is $0<k<1$.

With the arrangement, it is possible to easily work out the print developing bias DVBp, based on the reference developing bias DVB0, the previous print-time developing bias DVB1, and the coefficient k.

In the image forming apparatus, the arithmetic section may be arranged so as to set the coefficient k in such a manner that the greater the previous print-time developing bias is, the greater the coefficient k is.

With the arrangement, the greater the previous printing developing bias is, the greater the printing developing bias DVBp is. It follows that the greater the image density before the current image density adjustment operation (i.e., the image density after the previous image density adjustment operation) is, the greater the image density after the current image density adjustment operation is. This makes it possible to more appropriately decrease the image density change between an image printed on a page before the image density adjustment operation and an image printed on a next page after the image density adjustment operation.

In the image forming apparatus, the arithmetic section may be arranged so as to change the coefficient k in accordance with a difference between the reference developing bias and the previous print-time developing bias.

With the arrangement, the coefficient k is changed depending on the difference between the reference developing bias DVB0 and the previous printing developing bias DVB1. For example, the greater the difference between the reference developing bias DVB0 and the previous printing developing bias DVB 1 is, the greater the coefficient k is. In this case, the greater the image density before the current image density adjustment operation (i.e., the image density after the previous image density adjustment operation), the greater the image density after the current image density adjustment operation is. This makes it possible to more appropriately decrease the image density change between the image printed on the page before the image density adjustment operation and the image printed on the next page after the image density adjustment operation.

The image forming apparatus may be arranged so that the arithmetic section determines the print-time developing bias to the reference developing bias in a case where the previous print-time developing bias falls within a high range of the predetermined range of the developing bias.

With the arrangement, the print-time developing bias is set to the reference developing bias in a case where the previous print-time developing bias falls within the high range of the predetermined range of the developing bias. As such, it is possible to simplify the control of the developing bias. That is, in a case where the developing bias falls within the high range of the predetermined range, the ratio of the change in the image density to the change in the developing bias is small. In view, in a case where the developing bias falls within the high range of the predetermined range, it is possible to set the print-time developing bias directly to the reference developing bias. This can simplify the control of the developing bias.

The image forming apparatus may be arranged so that: in a case where the image density adjustment operation is performed while a print job is being executed, the control section stops the print job and continues the image density adjustment operation; and in a case where the image density adjustment operation is performed while the print job is being executed, the arithmetic section determines the print-time developing bias to a value between the reference developing bias and the previous print-time developing bias, whereas in a case where the image density adjustment operation is performed while no print job is being executed, the arithmetic section determines the print-time developing bias to the reference developing bias.

With the arrangement, in a case where the image density adjustment operation is performed while the print job is being executed, the arithmetic section sets the print-time developing bias to the value between the reference developing bias and the previous print-time developing bias. In this case, it is possible to (i) decrease the image density decrease between the image printed on the page printed before the image density adjustment operation and the image printed on the next page after the image density adjustment operation and (ii) prevent as appropriate occurrence of a situation that the image density is significantly changed between before and after the image density adjustment operation so that the images on the pages cause discomfort in a reader.

On the other hand, in a case where the image density adjustment operation is performed while no print job is being executed, there is rarely a problem that the image density is changed between the image printed on the page before the image density adjustment operation and the image printed on the page printed after the image density adjustment operation so that the images on the pages cause discomfort in the reader. It follows that, in a case where the image density adjustment is performed while no print job is being executed, there is no problem even if the print-time developing bias is set to the reference developing bias. This makes it possible to simplify the control of the developing bias.

The image forming apparatus may be arranged so that: in a case where the image density adjustment operation is performed while a print job is being executed, the control section stops the print job and continues the image density adjustment operation; the arithmetic section determines whether the print job is a high or low coverage rate print job or a medium coverage rate print job; and in a case where (i) the image density adjustment operation is performed while the print job is being executed and (ii) the print job is the high coverage rate print job or the low coverage rate print job, the arithmetic section determines the print-time developing bias to a value between the reference developing bias and the previous print-time developing bias, whereas in a case where the image density adjustment operation is performed while no print operation is being executed, the arithmetic section determines the print-time developing bias to the reference developing bias.

With the arrangement, in a case where the print job is the high coverage rate print job or the low coverage rate print job, there is a problem that when the image density is changed, the change in the image density is easily noticeable. In view, in a case where (i) the image density adjustment operation is performed while the print job is being executed and (ii) the print job is the high coverage rate print job or the low coverage rate print job, the arithmetic section determines the print-time developing bias to a value between the reference developing bias and the previous print-time developing bias. In this case, it is possible to (i) decrease the image density change between the image printed on the page before the image density adjustment operation and the image printed on the next page after the image density adjustment operation and thereby (ii) prevent as appropriate the occurrence of the situation that the image density is significantly changed between before and after the image density adjustment operation so that the images on the pages cause discomfort in the reader.

On the other hand, in a case where the image density adjustment operation is performed while no print job is being executed, there is rarely a problem that the image density is changed between before and after the image density adjustment operation so that the images on the pages cause discomfort in the reader. It follows that in a case where the image density adjustment is performed while no print job is being executed, there is no problem even in a case where the print-time developing bias is determined to the reference developing bias. This makes it possible to simplify the control of the developing bias.

The image forming apparatus may be arranged so that: in a case where the control section sets the print-time developing bias to a value between the reference developing bias and the previous print-time developing bias by the image density adjustment operation, the control section modifies, at least one time after the image density adjustment operation and before a next image density adjustment operation, the print-time developing bias in a direction approaching the reference developing bias.

With the arrangement, in a case where the print-time developing bias is set to the value between the reference developing bias and the previous print-time developing bias, the print-time developing bias is modified, at least one time after the image density adjustment operation and before the next image density adjustment operation, in the direction approaching the reference developing bias.

With this, it is possible to concurrently bring about (i) an effect of preventing occurrence of a situation that the image density is significantly changed between before and after the image density adjustment operation and (ii) an effect of approximating the image density to the target image density or setting the image density to the target image density.

The present invention is not limited to the description of each of Embodiments 1 through 3, but may be altered by a skilled person in the art within the scope of the claims. An embodiment derived from a proper combination of technical means disclosed in different embodiments is also encompassed in the technical scope of the present invention.

REFERENCE SIGNS LIST

2: developing apparatus
3: photoreceptor drum
6: intermediate transfer belt unit
61: intermediate transfer belt
100: image forming apparatus
110: main body apparatus
120: automatic document processing apparatus
202: developing roller
206: photosensor (density sensor)
212: printer
301: control section
302: storage section
306: operation section
309: image forming section
312: developing bias electric supply source

The invention claimed is:

1. An image forming apparatus, comprising:

a photoreceptor;

a developing device that forms a toner image by visualizing an electrostatic image formed on the photoreceptor;

a developing bias supply power source;

a control section that controls a developing bias supplied from the developing bias supply power source to the developing apparatus;

a density sensor that detects a density of the toner image; and an arithmetic section that, for an image density adjustment operation, determines a print-time developing bias that the controlling section sets for printing, the arithmetic section determining the print-time developing bias in accordance with a detection result obtained by the density sensor by detecting a plurality of image density detection toner images that are formed by changing a developing bias, wherein:

in a case where a previous print-time developing bias, which is a print-time developing bias having been set by a previous image density adjustment operation, falls within at least a low range of a predetermined range of the developing bias, the arithmetic section determines the print-time developing bias to a value between a reference developing bias for a target image density and the previous print-time developing bias.

2. The image forming apparatus as set forth in claim 1, wherein:

the arithmetic section calculates the print-time developing bias by the following equation:

$$DVBp=(DVB0-DVB1)\times k+DVB1,$$

where DVBp is the print-time developing bias, DVB0 is the reference developing bias, DVB1 is the previous print-time developing bias, k is a coefficient, wherein the coefficient k is $0<k<1$.

3. The image forming apparatus as set forth in claim 2, wherein the arithmetic section sets the coefficient k in such a manner that the greater the previous print-time developing bias is, the greater the coefficient k is.

4. The image forming apparatus as set forth in claim 2, wherein the arithmetic section changes the coefficient k in accordance with a difference between the reference developing bias and the previous print-time developing bias.

5. The image forming apparatus as set forth in claim 1, wherein the arithmetic section determines the print-time developing bias to the reference developing bias in a case where the previous print-time developing bias falls within a high range of the predetermined range of the developing bias.

6. The image forming apparatus as set forth in claim 1, wherein:

in a case where the image density adjustment operation is performed while a print job is being executed, the control section stops the print job and continues the image density adjustment operation; and in a case where the image density adjustment operation is performed while the print job is being executed, the arithmetic section determines the print-time developing bias to a value between the reference developing bias and the previous print-time developing bias, whereas in a case where the image density adjustment operation is performed while no print job is being executed, the arithmetic section determines the print-time developing bias to the reference developing bias.

7. The image forming apparatus as set forth in claim 1, wherein:

in a case where the image density adjustment operation is performed while a print job is being executed, the control section stops the print job and continues the image density adjustment operation;

the arithmetic section determines whether the print job is a high or low coverage rate print job or a medium coverage rate print job; and in a case where (i) the image density adjustment operation is performed while the print job is being executed and (ii) the print job is the high coverage rate print job or the low coverage rate print job, the arithmetic section determines the print-time developing bias to a value between the reference developing bias and the previous print-time developing bias, whereas in a case where the image density adjustment operation is performed while no print operation is being executed, the arithmetic section determines the print-time developing bias to the reference developing bias.

8. The image forming apparatus as set forth in claim 1, wherein in a case where the control section sets the print-time developing bias to a value between the reference developing bias and the previous print-time developing bias by the image density adjustment operation, the control section modifies, at least one time after the image density adjustment operation and before a next image density adjustment operation, the print-time developing bias in a direction approaching the reference developing bias.

9. An image forming method, comprising:

an arithmetic step for determining, for an image density adjustment operation, a print-time developing bias that a controlling section sets for printing, the arithmetic step including determining the print-time developing bias in accordance with a detection result obtained by detecting densities of a plurality of image density adjustment toner images that are formed by changing a developing bias, wherein:

in a case where a previous print-time developing bias, which is a print-time developing bias having been set by a previous image density adjustment operation, falls within at least a low range of a predetermined range of the developing bias, the arithmetic step determines the print-time developing bias to a value between a reference developing bias for a target image density and the previous print-time developing bias.

* * * * *